US010384177B2

(12) United States Patent
Regattieri et al.

(10) Patent No.: US 10,384,177 B2
(45) Date of Patent: Aug. 20, 2019

(54) ROTOR AND STIRRING DEVICE

(71) Applicant: VERSALIS S.P.A., San Donato Milanese (IT)

(72) Inventors: Giovanni Regattieri, Rivalta S/M Rodigo (IT); Gianni Marchetti, Roncoferraro (IT); Alessandro Brandolin, Mantova (IT)

(73) Assignee: Versalis S.P.A., San Donato Milanese (IT)

( * ) Notice: Subject to any disclaimer, the term of this patent is extended or adjusted under 35 U.S.C. 154(b) by 30 days.

(21) Appl. No.: 15/320,442

(22) PCT Filed: Aug. 12, 2015

(86) PCT No.: PCT/EP2015/068510

§ 371 (c)(1),
(2) Date: Dec. 20, 2016

(87) PCT Pub. No.: WO2016/023931

PCT Pub. Date: Feb. 18, 2016

(65) Prior Publication Data

US 2018/0065096 A1 Mar. 8, 2018

(30) Foreign Application Priority Data

Aug. 13, 2014 (IT) ..... MI2014A1493

(51) Int. Cl.
*B01F 7/00* (2006.01)
*B01F 7/16* (2006.01)
*B01F 7/22* (2006.01)

(52) U.S. Cl.
CPC ..... *B01F 7/00366* (2013.01); *B01F 7/00208* (2013.01); *B01F 7/00266* (2013.01); (Continued)

(58) Field of Classification Search
CPC ..... B01F 7/00208; B01F 7/00266; B01F 7/00366; B01F 7/00641; B01F 7/1675; B01F 7/22
See application file for complete search history.

(56) References Cited

U.S. PATENT DOCUMENTS 183,253 A 10/1876 Cunningham
199,321 A 1/1878 Symer
(Continued)

FOREIGN PATENT DOCUMENTS

EP 0015050 A1 9/1980
EP 0880993 A1 12/1998
(Continued)

OTHER PUBLICATIONS

NPL document, titled "Appendix A Geometry for Aerodynamicists", dated Oct. 23, 1997, and web archived in 2011 at https://web.archive.org/web/20110814071216/http://www.dept.aoe.vt.edu/~mason/Mason_f/CAtxtAppA.pdf. Dated Oct. 23, 1997 (Year: 1997).*
(Continued)

*Primary Examiner* — Tony G Soohoo
(74) *Attorney, Agent, or Firm* — Abel Schillinger, LLP

(57) ABSTRACT

The present invention relates to a rotor that comprises a series of shaped rotor blades whose circumferential section forms a standard NACA four-digit airfoil. Said rotor can be inserted in a stirring device that also comprises a stator, on whose inner surface shaped stator blades are positioned, whose circumferential section forms a standard NACA four-digit airfoil.

22 Claims, 7 Drawing Sheets

(52) U.S. Cl.
CPC ..... *B01F 7/00641* (2013.01); *B01F 7/1675* (2013.01); *B01F 7/22* (2013.01)

(56) References Cited

U.S. PATENT DOCUMENTS 2,622,371 A * 12/1952 Zuiderhoek ..... B24B 19/14 33/27.01
3,133,728 A * 5/1964 Janke ..... B28C 5/4286 366/329.2
3,365,176 A * 1/1968 Christensen ..... B01F 7/18 366/147
3,374,989 A * 3/1968 Todtenhaupt ..... B01F 7/00125 366/327.3
3,397,869 A * 8/1968 Webster ..... B01F 7/00141 236/68 R
3,414,240 A * 12/1968 Jung ..... B01F 7/1675 366/302
3,709,664 A 1/1973 Krekeler et al.
4,090,696 A * 5/1978 Kipke ..... B01F 7/00141 366/327.4
4,136,972 A * 1/1979 Doom ..... B01F 7/183 366/262
4,238,159 A * 12/1980 Tielens ..... C01F 7/144 366/327.2
4,468,130 A 8/1984 Weetman
4,552,461 A * 11/1985 Ott ..... B01F 7/0025 366/194
4,650,338 A 3/1987 List et al.
4,650,343 A * 3/1987 Doom ..... B01F 7/18 366/279
4,722,608 A * 2/1988 Salzman ..... B01F 7/00016 366/270
4,775,243 A 10/1988 Baumgartner
4,779,990 A 10/1988 Hjort et al.
4,824,257 A 4/1989 List et al.
4,826,324 A 5/1989 Kunz et al.
4,889,431 A 12/1989 Liechti
4,896,971 A * 1/1990 Weetman ..... B01F 3/04531 261/77
5,052,892 A 10/1991 Fasano
5,121,992 A 6/1992 List et al.
5,147,135 A 9/1992 List et al.
5,198,156 A 3/1993 Middleton et al.
5,297,938 A 3/1994 Von Essen et al.
5,326,226 A 7/1994 Wyczalkowski et al.
5,327,710 A * 7/1994 Plamper ..... A01D 34/005 56/255
5,344,235 A * 9/1994 Weetman ..... B01F 7/00016 366/270
5,525,269 A * 6/1996 Connolly ..... B01F 3/04609 261/93
5,595,475 A 1/1997 Weiss et al.
5,711,141 A * 1/1998 Pitman ..... A01D 34/73 56/255
5,762,417 A 6/1998 Essen et al.
5,823,674 A 10/1998 Liechti et al.
5,904,423 A 5/1999 Forschner et al.
5,934,801 A 8/1999 List et al.
6,796,707 B2 * 9/2004 Gigas ..... B01F 7/00158 366/327.1
2002/0085450 A1 * 7/2002 Engel ..... B01F 7/00158 366/326.1
2002/0176322 A1 * 11/2002 Kupidlowski ..... B01F 7/001 366/330.3
2004/0087814 A1 * 5/2004 Gnagnetti ..... B01F 7/0025 562/412
2005/0229573 A1 * 10/2005 Curran ..... A01D 34/73 56/255
2005/0249599 A1 * 11/2005 Hemsley ..... F01D 5/225 416/204 R
2010/0034050 A1 2/2010 Erb et al.
2018/0065096 A1 * 3/2018 Regattieri ..... B01F 7/00208

FOREIGN PATENT DOCUMENTS

FR 2212173 A1 7/1974
WO 2009/082676 A1 7/2009
WO 2009/120965 A2 10/2009
WO 2010/059572 A1 5/2010

OTHER PUBLICATIONS

"NACAAirfoil series", https://web.archive.org/web/20060923235438/http://people.clarkson.edu/~pmarzocc/AE429/The%, 7 pages. Archive Dated Sep. 2006. (Year: 2006).*
International Search Report for PCT/EP2015/068510 dated Nov. 17, 2015, 12 pgs.
J.H. Rushton "Power Characteristics of Mixing Impellers, Part II", J.H. Rushton, E.W. Costich, and H.J. Everett, Chem. Eng. Prog., vol. 46, No. 9, (1950), pp. 467-476.

* cited by examiner

ROTOR AND STIRRING DEVICE

The present invention relates to a rotor that can be used in a stirring device. The present invention further relates to a stirring device that can be used in many procedures including a single-phase or multi-phase fluid mixing operation.

In the present patent application, all the operating conditions included in the text must be considered as preferred conditions even if this is not specifically stated.

For the purpose of this text the term "comprise" or "include" also comprises the term "consist in" or "essentially consisting of".

For the purpose of this text the definitions of the intervals always comprise the extremes unless specified otherwise.

In the present patent application multi-phase fluid means a fluid containing at least two phases, and preferably three phases. A multi-phase fluid is for example a fluid that contains a liquid and a gas phase, or a liquid and a solid phase, or containing a liquid, a gas and a solid phase.

In the field of mixing fluids, there is a plurality of technical solutions, developed according to the characteristics of the fluids treated and the purpose of the mixing. With regard to low viscosity fluids, typically between 0.1 and 10 cP, for example, aqueous solutions and/or light hydrocarbons, operating in turbulent regime (Re>10000), there were fundamentally three types of impellers traditionally used until the mid-twentieth century: turbines with vertical blades, turbines with inclined blades and marine propellers. This type of impellers generates a radial, mixed or axial flow, respectively. They were usually installed in vertical cylindrical tanks equipped with 3 or 4 vertical baffles that extend radially from the side wall of the outer body inwards. With regard to the characterisation in terms of reference configuration and absorbed power, it is worth quoting the work done by J. H. Rushton "Power Characteristics of Mixing Impellers, Part II, J. H. Rushton, E. W. Costich, and H. J. Everett, Chem. Eng. Prog., Vol 46, No. 9, (1950), pp. 467-476", which describes a turbine with vertical blades commonly indicated as a "Rushton turbine".

Still for fluids having viscosity between 0.1 and 10 cP, a series of impellers known as "hydrofoils" were developed from 1980 onwards, which generate a prevalently axial flow and that are usually produced using sheet metal forming, bending and twisting processes rather than forging/melting, as usually happens for marine propellers. Furthermore, the possibility to assemble the blades thus obtained on a hub and therefore on the shaft through bolting or keying allows them to be easily introduced into tanks through appropriate manholes also for large impellers, which is a limit for marine propellers that are generally made of a single part. Said impellers are widely used in industry for mixing single phase or multi-phase fluids, for suspending solids and dispersing gases. The basic concept introduced was that of applying airfoils to the blades by varying the inclination and curvature according to the local radius of the impeller, i.e. the local tangential speed.

One of the first patents to divulge "hydrofoil" impellers is U.S. Pat. No. 4,468,130 based on which Lightnin now manufactures the commercial impeller A310. Variations of "hydrofoil" impellers have been proposed in U.S. Pat. Nos. 5,052,892; 5,297,938; 5,595,475; 5,297,938 and WO 2010/059572.

Variations of "hydrofoil" impellers have been developed with wider blades, typically used in the presence of fluids with viscosity comprised between 10 and 1000 cP or in the presence of gases, such as those described in U.S. Pat. Nos. 4,896,971; 5,762,417 and 5,326,226.

With the aim of effectively dispersing a gas in a liquid, some modified versions of the Rushton turbine have been developed, adopting concave blades instead of vertical ones. The first turbine belonging to said category is the turbine known as the Smith turbine, equipped with semi-circular blades. Later some variations of said turbine were patented, as described in U.S. Pat. Nos. 4,779,990; 5,198,156; EP 0880993; U.S. Pat. Nos. 5,904,423; 0,199,321; WO 2009/082676, wherein the blades are characterised in that they are concave and increasingly evolved with semi-circular, parabolic, asymmetrical and inclined shapes. All these variations have the main innovative and advantageous characteristic with respect to the Rushton turbine of being able to effectively disperse the gas introduced and maintain high power input to the system also at high gas supply flow rates.

The impellers used for low viscosity fluids are able to effectively and efficiently mix fluids in turbulent regime, but are characterised in that the distribution of the turbulence, the speed gradients and the strains generated in the fluid are not homogenous. More precisely, they are characterised in that they have an area with a high level of turbulence in proximity to the impeller and one or more areas of relative calm away from the impeller. For most fluids, this is not usually a problem and, in fact, such mixing systems are widely used in industry. However, such systems drastically reduce their mixing capacity if applied to systems with high viscosity, either widespread or localised. For fluids with viscosity over 100 cP, operating with a transition regime (Re that ranges from 10 to 10000), impellers with a dual fluid thrust direction have been developed that modify the existing turbines with inclined blades or hydrofoils, adding an extension with an inverse inclination to the outer end of the blade. Said impellers typically have higher diameters with respect to the impellers previously mentioned, even though they do not reach the wall of the tank. The impellers described in U.S. Pat. Nos. 6,796,707 and 4,090,696 belong to this type, both installed with traditional vertical baffles.

U.S. Pat. No. 3,709,664 discloses a rotary agitator having a rotation shaft to which sets of level and flat blades are connected that extend radially outwards, equidistant from each another and along the rotation axis, with a different inclination with respect to the rotation axis. The blades described do not have reversal points. Fixed to the interior surface of the outer body is a set of stationary, level and flat counter-blades, equidistant from each other, which extend radially from the interior surface of the outer body towards the rotation axis. Said sets of counter-blades are inclined with respect to the rotation axis and are arranged to as to be interposed with the sets of blades. The counter-blades do not have reversal points. The main limit of this technology lies in the fact that such apparatus is not able to generate effective mixing, since it cannot generate significant pumping in the axial direction. Such technology is therefore particularly limited in the event of mixing multi-phase fluids, for example a mixture of water and heavy solids.

U.S. Pat. No. 4,136,972 describes a mixing apparatus that includes a stator, a rotation shaft, a first and a second group of blades and counter-blades with a rectangular section. Each blade is fixed to the rotation shaft and extends radially towards the walls of the container; each counter-blade is fixed to the walls of the container and extends radially towards the rotation shaft. The blades and counter-blades are interposed with one another. Each blade and counter-blade is comprised of two adjacent parts inclined with respect to the other at their midpoint. The inclination of the two adjacent parts allows axial pumping to be obtained upwards near to the shaft and downwards near to the wall of the outer body;

however, the inclination of the blades, with a constant angle, and the position of the reversal point lead to the limits in terms of the efficiency of the apparatus itself.

U.S. Pat. No. 4,650,343 discloses a method for mixing or dehydrating particulate material using a mixer that has the following characteristics. The mixer comprises a container and a rotation axis coinciding with the axis of the container. Fixed to the rotation shaft, there is a plurality of blades that extend radially outwards. These blades can generate a downward thrust internally and an upward thrust externally or vice versa. The blades have a dual pitch allowing the reversal of the thrust for a determined rotation direction. The blades have an inclination with a constant angle. Precisely such inclination and the position of the reversal point determine the limit in terms of efficiency of the apparatus itself.

For fluids with high viscosity, typically over 10000 cP, operating in laminar flow (Re<10), impellers have been developed with a diameter close to that of the tank in which they are installed. Anchors, screws and single or multiple principle ribbons belong to this category.

These impellers can effectively and efficiently mix fluids in laminar flow. They are characterised in that the speed gradients and strains are fairly homogenous. However, the speeds imparted to the fluid are usually very modest, and turbulence cannot be generated. This can nullify the ability to suspend solids present and can reduce the ability to disperse any gas. Furthermore, such systems drastically reduce their mixing capacity if applied to systems with low viscosity, either widespread or localised.

For fluids having extremely high viscosity, typically over 100000 cP, typical of molten polymers and mixtures, in industry extruders or mixers of various types are usually used, such as for example those described in U.S. Pat. Nos. 5,147,135; 5,823,674; 5,121,992; 5,934,801; 4,889,431; 4,824,257; 0,183,253; 4,826,324; 4,650,338; 4,775,243 and the like. They are substantially horizontal machines, equipped with one or more rotatable shafts, equipped with a screw or a plurality of arms and counter-arms of various shapes that locally mix the supplied fluid. The flow within the machine is substantially one-directional and co-axial with the shaft.

In the prior art, mixing systems are not known using the technologies developed and widely applied to turbomachines such as compressors, turbines and pumps. Such machines are equipped with a plurality of rotors and stators, both equipped with a group of blades having variable fluid dynamic profiles, which allow the mechanical energy provided by the machine to be transformed into pressure energy (compressors and pumps) or vice versa (turbines).

There are fluids whose rheology characteristics depend on the motion field to which they are subjected. In particular, for some fluids the viscosity is low if the fluid is subjected to high speed gradients and is high if the fluid is still (non-Newtonian fluids). Similar behaviour can be noted in fluids with the presence of solids, especially if they are sticky, which can lead to caking or gelation with the resulting local increase in transport properties. Furthermore, in the event of a dispersed phase (liquid, gas or solid) subject to coalescence and breaking, the level of turbulence, speed gradients and strains play a fundamental role in the dispersed phase size distribution.

For all these types of fluids a local reduction in the level of agitation (for example in the calm areas with low flow) can lead to a local increase in viscosity and therefore the passage to laminar regime; for these reasons impellers developed for turbulent flow are not very effective. On the other hand, if the fluid is sufficiently homogenously agitated, the viscosity is low; for these reasons impellers developed for laminar flow are not very effective. Finally, not even dual thrust direction impellers developed for intermediate flows are sufficiently effective, and systems equipped with a plurality of rotors and horizontal baffles are not very effective.

The applicant proposes a new rotor that can be used in a stirring device able to overcome all the criticalities of the state of the art, allowing effective and efficient mixing of single-phase and multi-phase fluids to be obtained and guaranteeing a high level of mixing and homogeneity.

The present invention therefore relates to a rotor which includes a rotation shaft, a series of shaped rotor blades arranged along the whole or part of the length of the rotation shaft, said blades extending parallel to a plane orthogonal to the rotation axis; said series of shaped rotor blades contains at least one level of shaped rotor blades; each level contains at least two shaped rotor blades equally spaced about said rotation shaft; said shaped rotor blades are connected to the rotation shaft by means of one of their ends; said shaped rotor blades being characterized in that:

a) the shaped rotor blade comprises at least one reversal point (6) of the thrust to the fluid, said reversal point divides said shaped rotor blade into at least two elements (4 and 5) which extend radially with respect to one another, so that each element has a direction of thrust in the opposite direction with respect to the other,
b) the circumferential section of each element forms a Standard NACA four-digit airfoil shown as Digit 1, Digit 2, Digit 3 and Digit 4, in which:
   i. the parameters m, p, and t vary radially along the direction of extension of the shaped rotor blade,
   ii. the chord length c that connects the leading edge with the trailing edge of said profile varies radially along the direction of extension of the shaped rotor blade,
   iii. the chord has an inclination a with respect to the orthogonal plane to the rotation axis that varies radially along the direction of extension of the shaped rotor blade.

The present invention also relates to a stirring device that comprises:

the rotor described and claimed herein, having improved characteristics, which has the function of stirring a single-phase or multi-phase fluid imparting motion, and
a stator that comprises an outer body and a series of shaped stator blades arranged on all or part of the inner side surface of said body; said series of shaped stator blades contains at least one level of shaped stator blades; each level contains at least two shaped stator blades equally spaced in the angular direction; the shaped stator blades are fixed to the inner side surface of said outer body by one of their ends, said stator having the function of transforming the motion generated by the rotor into predominantly axial flow.

In the present text, circumferential section means a section according to right cylindrical surfaces with generating line parallel to the rotation axis and circular directrix concentric to the rotation axis itself.

In the present patent application the rotation axis coincides with the axis of the rotation shaft.

The rotor according to the present patent application is particularly advantageous in applications that involve single-phase or multi-phase fluids with viscosity greater than 0.1 cP, preferably comprised between 0.1 cP and 1000 cP, and in particular in applications that involve non-Newtonian fluids.

With respect to stirring devices known in the state of the art developed for turbulent regime, the present invention can guarantee remarkable widespread homogenous turbulence, speed gradients and strains, reducing local peaks and minimising calm areas.

With respect to the stirring devices of the prior art developed for laminar regime, the system according to the invention can impart definitely higher speed and turbulence to the fluid.

With respect to rotary stirring devices of the state of the art developed for transition regime, the present invention is more efficient and effective in its capacity to mix and homogenise.

With respect to the turbomachines widely used in industry (such as for example compressors, turbines, and axial pumps), the present invention is not used to move fluids or obtain mechanical energy from the pressure energy contained therein, but to impart a multi-directional thrust to the fluid rather than a single-directional thrust, favouring and promoting recirculation and local mixing of the fluid, which uses mechanical energy to obtain mixing.

Further objects and advantages of the present invention will become clearer from the following description and appended drawings, given by way of non-limiting illustration only.

In FIG. 3 points (8), (9), (10) and (11) are some of the circumferential sections of each element (4 and 5), of the shaped rotor blade (3) as can be understood better by reading the text.

In FIG. 4 points (27), (30), (17) and (18) are some of the circumferential sections of each element (20 and 26), of the shaped stator blade (16) as can be understood better by reading the text.

Figure 5:
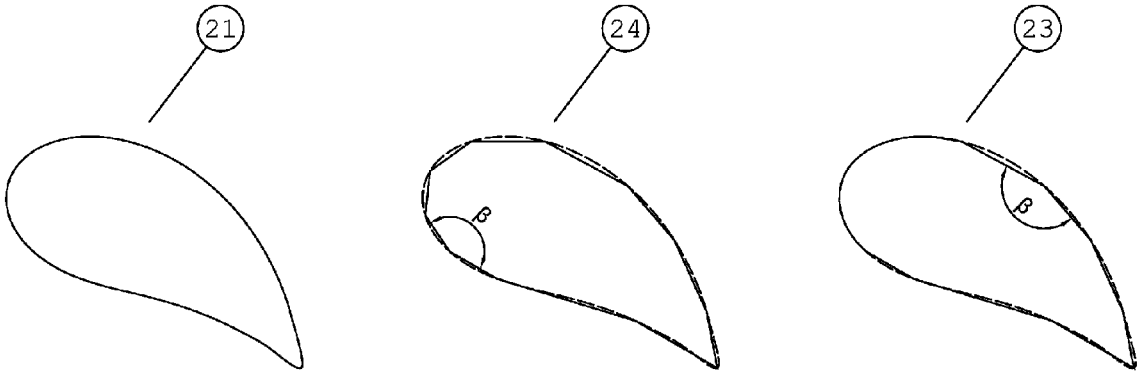

FIG. 5 describes some possible embodiments of the standard NACA four-digit airfoil formed by the circumferential sections of a shaped rotor blade or a shaped stator blade: said airfoil is made with a curvilinear profile in (21), with a continuous segmented profile in (24) and with a continuous profile comprising a combination of curvilinear sections and segments in (23), β is the angle formed by two consecutive segments.

Figure 6:
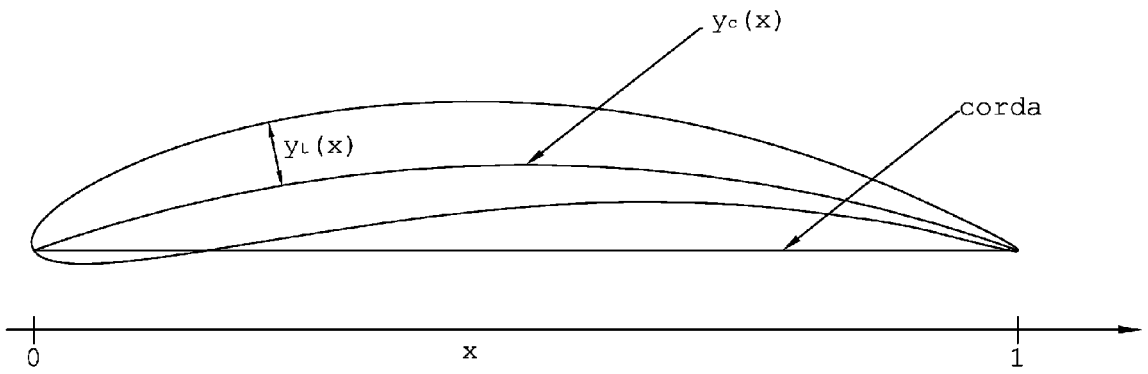

FIG. 6 illustrates a NACA airfoil in which the cord, the midline and the semi thickness are indicated.

Figure 7:
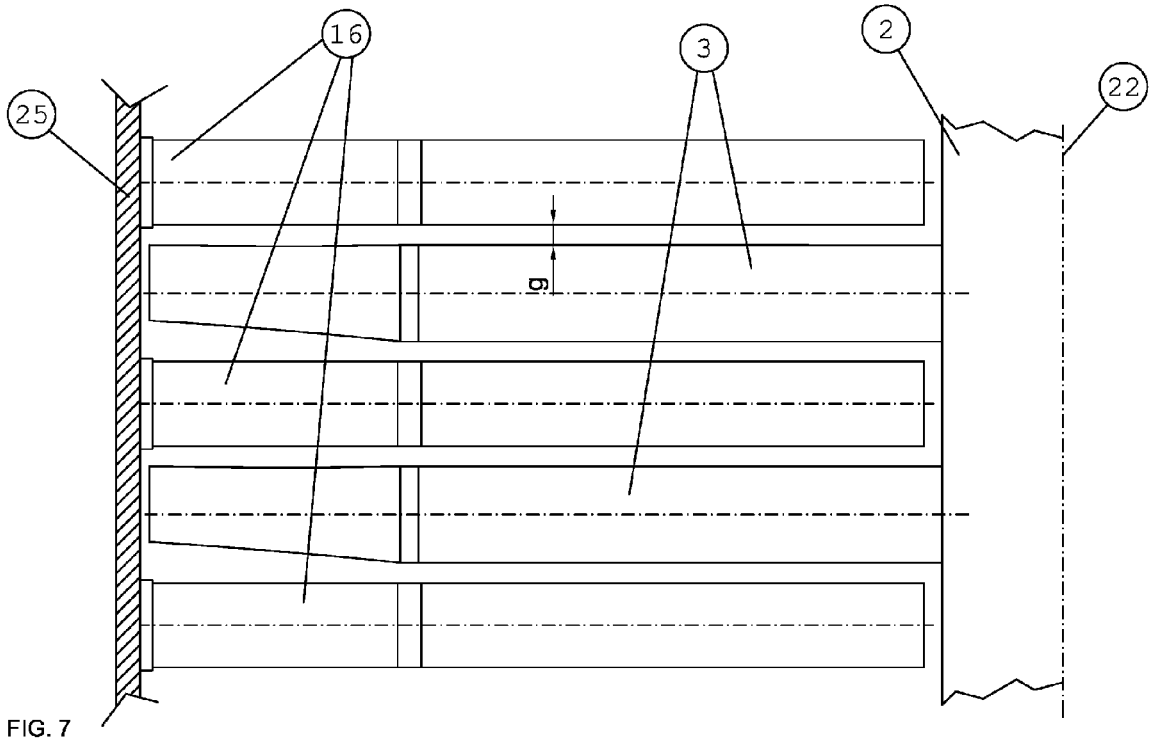

FIG. 7 illustrates the gap between shaped rotor blades and shaped stator blades.

DETAILED DESCRIPTION

Figure 1:
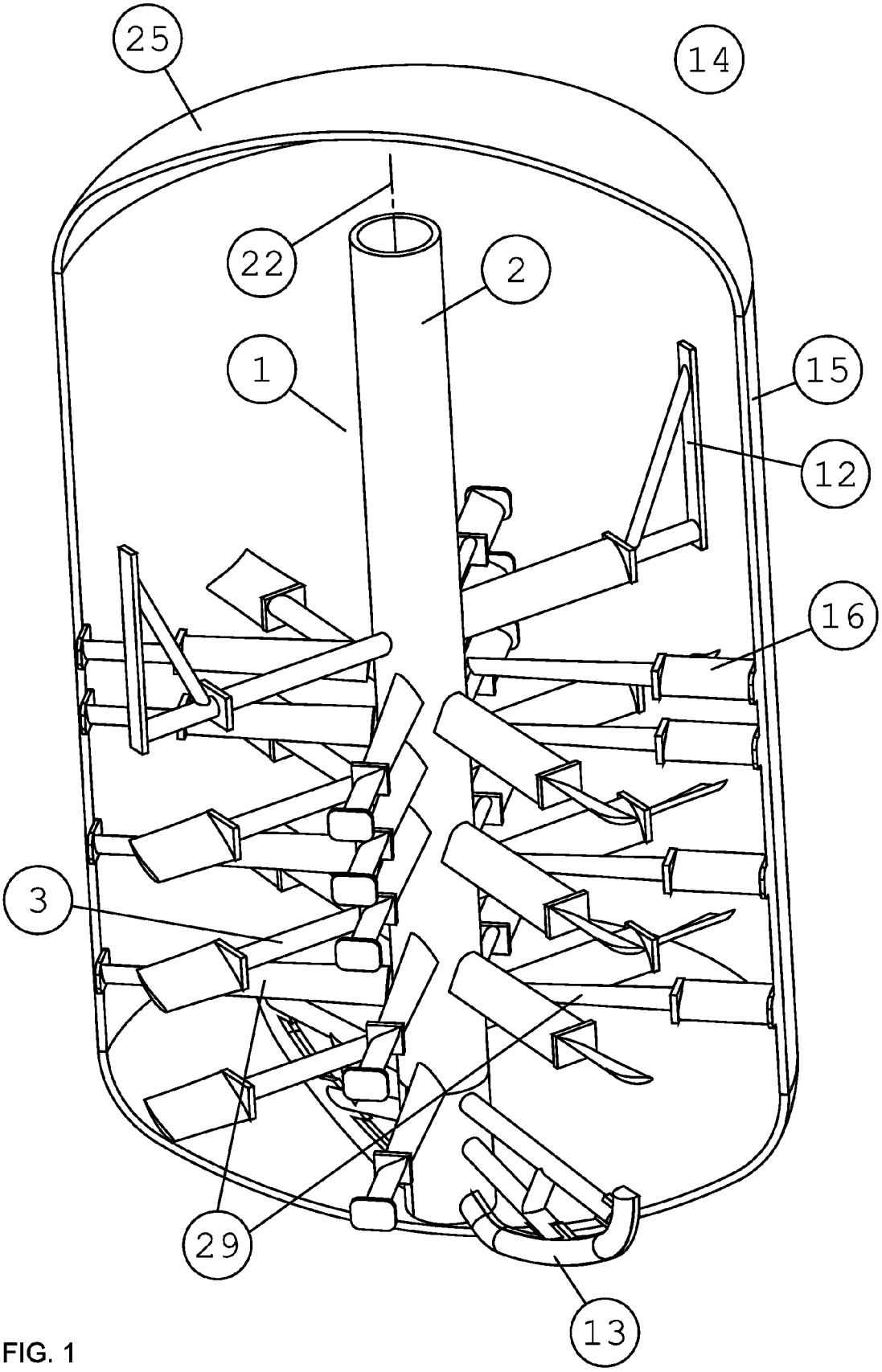
FIG. 1 illustrates a particular embodiment of the stirring device according to the present invention.
Figure 2:
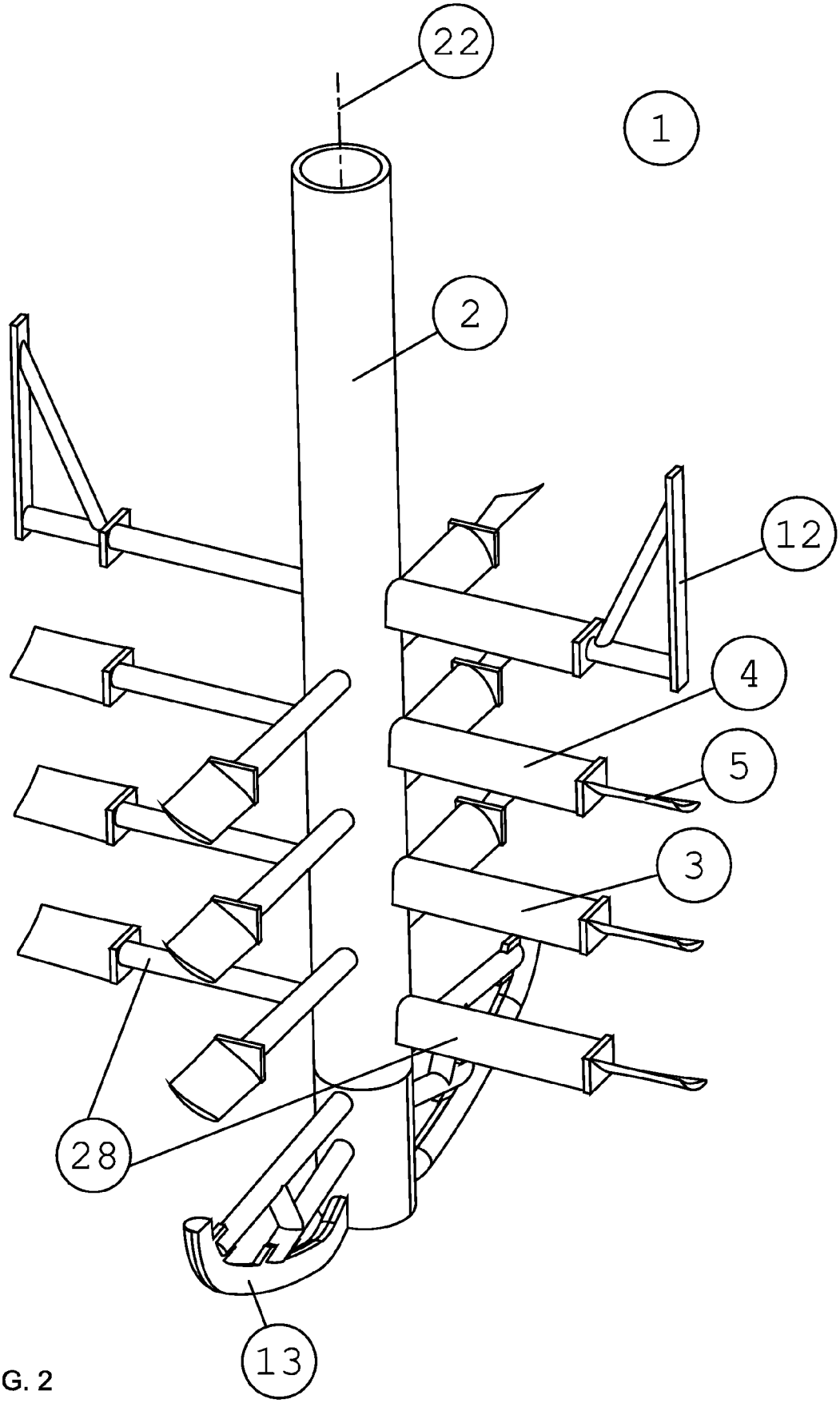
FIG. 2 illustrates a particular embodiment of the rotor according to the present invention.
Figure 3:
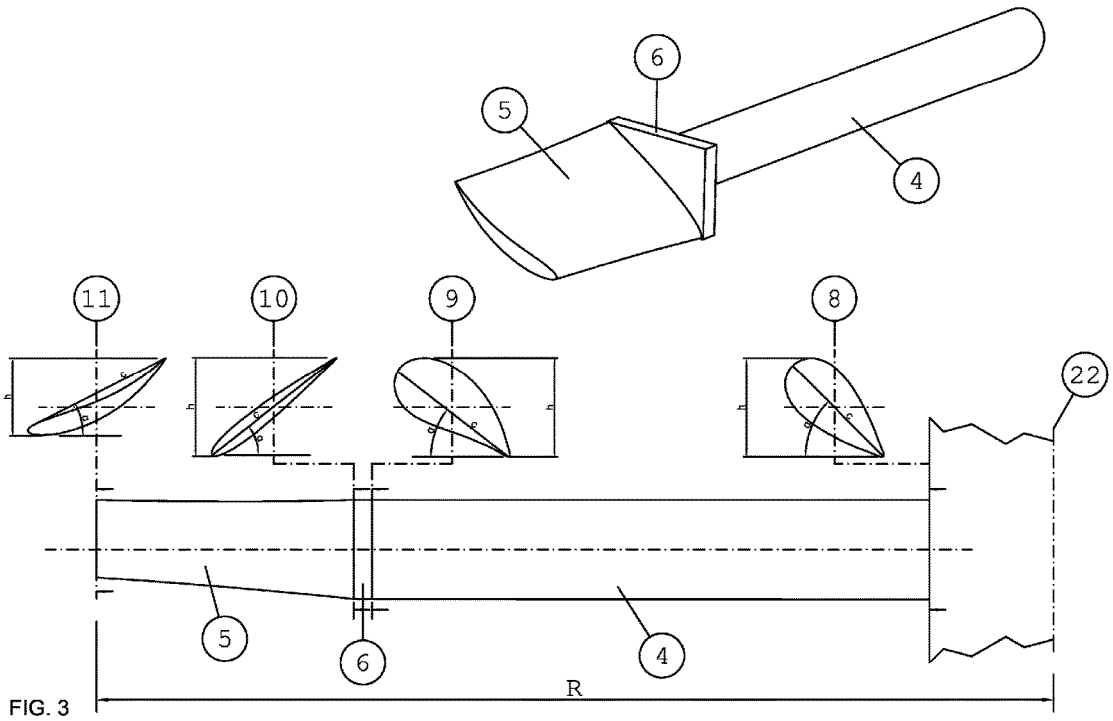
FIG. 3 illustrates a particular embodiment of a shaped rotor blade according to the present invention, wherein two elements (4) and (5) can be seen, separated by a reversal point (6).

Reference is made to FIGS. 1-7 to describe the present invention. FIG. 2 illustrates a rotor (1) which includes a rotation shaft (2), a series of shaped rotor blades (3) arranged along the whole or part of the length of the rotation shaft, said blades extending parallel to a plane orthogonal to the rotation shaft; said series of shaped rotor blades contains at least one level of shaped rotor blades (28); each level (28) of shaped rotor blades (3) contains at least two shaped rotor blades equally spaced about said shaft; said shaped rotor blades are connected to the rotation shaft by means of one of their ends; said shaped rotor blades being characterized in that:

a) the shaped rotor blade comprises at least one reversal point ((6) in FIG. 3) of the thrust to the fluid, which divides said shaped rotor blade into at least two elements ((4) and (5)), which extend radially with respect to one another, so that each element has a direction of thrust in the opposite direction with respect to the other, b) the circumferential section of each element forms a standard NACA four-digit airfoil shown as Digit 1, Digit 2, Digit 3 and Digit 4, in which:

i. the parameters m, p, and t vary radially along the direction of extension of the shaped rotor blade, ii. the chord length c that connects the leading edge with the trailing edge of said profile varies radially along the direction of extension of the shaped rotor blade, iii. the chord has an inclination a with respect to the orthogonal plane to the rotation axis that varies radially along the direction of extension of the shaped rotor blade.

Reference is now made to FIG. 6 to describe in detail a standard NACA four-digit airfoil according to the present invention.

The standard NACA four-digit airfoil, indicated as Digit 1, Digit 2, Digit 3 and Digit 4, better described below, is defined by a midline $y_c(x)$ and a semi-thickness $y_t(x)$ (perpendicular to the midline), which are functions of the position x along the chord. The variables x, $y_c$ and $y_t$ are expressed as a fraction of the length of the chord, therefore they are adimensional; in particular, x varies between 0 and 1.

The midline and semi-thickness are defined through these equations:

$$y_t(x) = \frac{t}{0.2}\left[0.2969\sqrt{x} - 0.1260x - 0.3516x^2 + 0.2843x^3 - 0.1015x^4\right]$$

$$y_c(x) = \begin{cases} \frac{m}{p^2}(2px - x^2), & 0 \le x \le p \\ \frac{m}{(1-p)^2}(1 - 2p + 2px - x^2), & p < x \le 1 \end{cases}$$

The upper and lower profiles of the NACA airfoil illustrated in FIG. 6 are given by the coordinates $(x_U, y_U)$ and $(x_L, y_L)$ respectively, which are expressed as a fraction of the length of the chord and therefore are adimensional; said coordinates are thus defined:

$$x_U = x - y_t \sin\theta,\ y_U = y_c + y_t \cos\theta$$

$$x_L = x + y_t \sin\theta,\ y_L = y_c - y_t \cos\theta$$

with $$\theta = \arctan\left(\frac{dy_c}{dx}\right)$$

$$\frac{dy_c}{dx} = \begin{cases} \frac{2m}{p^2}(p - x), & 0 \le x \le p \\ \frac{2m}{(1-p)^2}(p - x), & p < x \le 1 \end{cases}$$

The parameters and meaning of the NACA airfoil used are:

m, maximum camber, maximum value of the curve $y_c(x)$ (adimensional, fraction of the length of the chord), p position of the maximum camber along the chord (adimensional, fraction of the length of the chord), t maximum thickness (adimensional, fraction of the length of the chord), α angle of inclination of the chord with respect to the horizontal.

The digits that appear in the four-digit NACA code, typically used in the aeronautical field, are connected with the parameters that define the airfoil:

Digit 1: the parameter m, expressed in hundredths,

Digit 2: the parameter p, expressed in tenths,

Digits 3 and 4: the parameter t, expressed in hundredths.

Figure 4:
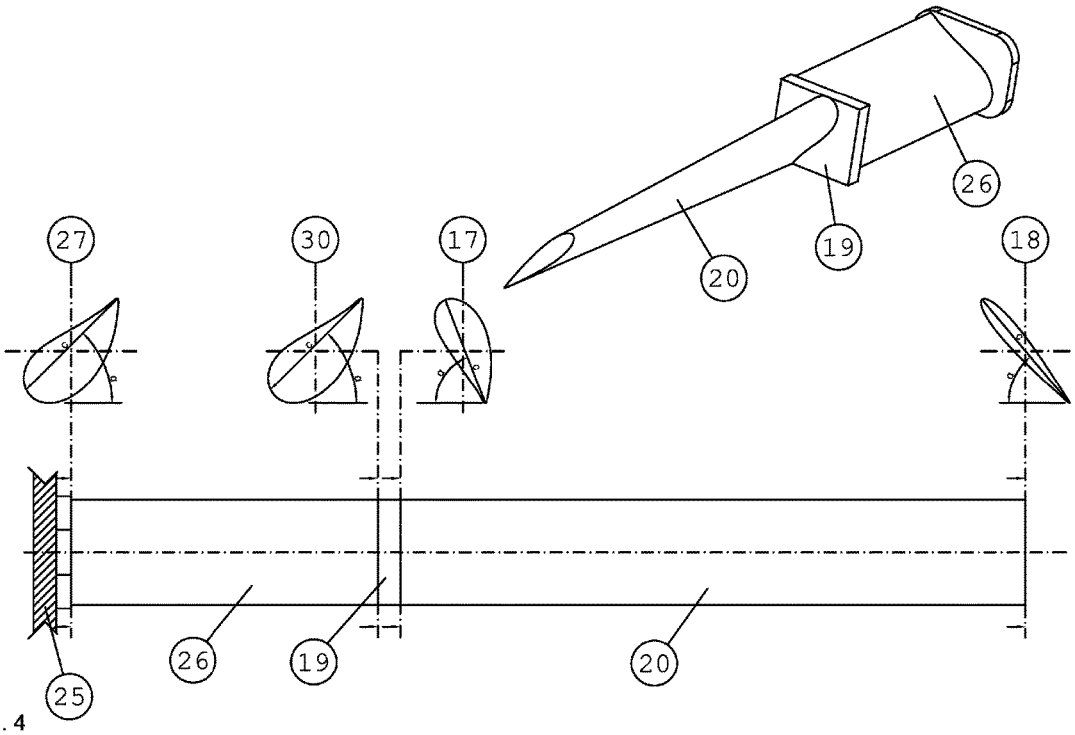
FIG. 4 illustrates an embodiment of a shaped stator blade according to the present invention, wherein two elements (20) and (26) can be seen, separated by a reversal point (19).

It is underlined that the sizes used ($x_U$, $y_U$, $x_L$, $y_L$, m, p, t) for defining the standard NACA four-digit airfoil thus defined are expressed as a fraction of the length of the chord and are therefore adimensional. Below, the length of the chord is indicated by c and is defined as a fraction of the diameter D of the rotor, therefore c is adimensional. In the description of the airfoil provided above, it is assumed that the chord is horizontal. For the embodiment, the airfoil is rotated so that the chord is inclined by an angle α with respect to the horizontal, as indicated in FIGS. 3 and 4. Below a is always positive and refers to the angles indicated in FIGS. 3 and 4.

FIG. 1 illustrates a stirring device with shaped rotor blades and shaped stator blades having improved geometric profiles.

Said stirring device (14) comprises:

the rotor (1) described and claimed herein, having improved characteristics, which has the function of stirring a single-phase or multi-phase fluid imparting motion, and a stator (15) that comprises an outer body (25) and a series of shaped stator blades (16) arranged on all or part of the inner side surface of said body; said series of shaped stator blades contains at least one level of shaped stator blades; each level (29) of shaped stator blades (16) contains at least two shaped stator blades equally spaced in the angular direction; the shaped stator blades are fixed to the inner side surface of said outer body (25) by one of their ends, said stator having the function of transforming the motion generated by the rotor into predominantly axial flow.

Reference is now made to FIG. 3 to describe the geometry of a shaped rotor blade. The shaped rotor blades are characterised in that they have the following characteristics:

the shaped rotor blade includes at least one reversal point (6) which divides the shaped rotor blade into at least two elements, (4) and (5), in such a way that each element has a direction of thrust in the opposite direction with respect to the other, the second element (5) extends radially starting from the first element (4), the circumferential section of each element forms a standard NACA four-digit airfoil shown as Digit 1, Digit 2, Digit 3 and Digit 4, as described in the text, in which:

i. the parameters m, p and t vary radially along the direction of extension of the shaped rotor blade, and in particular the parameter m varies between 0.001 and 0.25, p varies between 0.01 and 0.85, t varies between 0.015 and 0.75, ii. the length of the chord c that connects the leading edge with the trailing edge of said profile varies radially along the direction of extension of the shaped rotor blade, in particular it varies between 0.02 and 0.25 times the diameter D of the rotor (defined as two times R, where R represents the distance between the outer end of the shaped rotor blade (3) and the rotation axis (22 in FIGS. 1, 2, and 7)), iii. the chord has an inclination a with respect to the plane orthogonal to the rotation axis that varies radially along the direction of extension of the shaped rotor blade, in particular α varies between 15° and 75° with respect to the plane orthogonal to the rotation axis.

In particular, with reference to FIG. 3, four circumferential sections of the shaped rotor blade are identified, each of which forms a specific airfoil: the section (8) in correspondence of the connection with the rotation shaft (2), the section (9) in correspondence of the connection of the first element (4) with the reversal point (6), the section (10) in correspondence of the connection of the second element (5) with the reversal point (6), and the section (11) in correspondence of the outer end of the shaped rotor blade.

For such particular sections, the parameters of the standard NACA four-digit airfoil, m, p, t, c and α may preferably assume the values in the intervals specified below.

For the circumferential section (8) in correspondence of the connection with the rotation shaft (2), m ranges from 0.001 to 0.15, preferably from 0.001 to 0.091, p ranges from 0.01 to 0.85, preferably from 0.01 to 0.5, t ranges from 0.2 to 0.75, preferably from 0.35 to 0.45, c ranges from 0.02 to 0.15, preferably from 0.069 to 0.074, α ranges from 20° to 75°, preferably from 35° to 45°.

More preferably for the circumferential section (8) in correspondence of the connection with the rotation shaft (2) m ranges from 0.001 to 0.091, p ranges from 0.01 to 0.5, t ranges from 0.35 to 0.45, c ranges from 0.069 to 0.074, α ranges from 35° to 45°. For the circumferential section (9) in correspondence of the connection of the first element (4) with the reversal point (6), m ranges from 0.001 to 0.25, preferably from 0.091 to 0.144, p ranges from 0.01 to 0.7, preferably from 0.4 to 0.5, t ranges from 0.2 a 0.65, preferably from 0.43 to 0.45, c ranges from 0.02 to 0.2, preferably from 0.076 to 0.077, α ranges from 15° to 60°, preferably from 30° to 35°.

More preferably for the circumferential section (9) in correspondence of the connection of the first element (4) with the reversal point (6) m ranges from 0.091 to 0.144, p ranges from 0.4 to 0.5, t ranges from 0.43 to 0.45, c ranges from 0.076 to 0.077, α ranges from 30° to 35°.

For the circumferential section (10) in correspondence of the second element (5) with the reversal point (6), m ranges from 0.001 to 0.15, preferably from 0.001 a 0.064, p ranges from 0.01 to 0.7, preferably from 0.01 to 0.395, t ranges from 0.02 to 0.25, preferably from 0.12 to 0.15, c ranges from 0.04 to 0.2, preferably from 0.083 to 0.084, α ranges from 20° to 60°, preferably from 38° to 45°.

More preferably for the circumferential section (10) in correspondence of the connection of the second element (5) with the reversal point (6) m ranges from 0.001 to 0.064, p ranges from 0.01 to 0.395, t ranges from 0.12 to 0.15, c ranges from 0.083 to 0.084, a ranges from 38° to 45°.

For the circumferential section (11) in correspondence of the outer end of the shaped rotor blade m ranges from 0.001 to 0.25, preferably from 0.096 to 0.133, p ranges from 0.01 to 0.75, preferably from 0.5 to 0.526, t ranges from 0.015 to 0.25, preferably from 0.1 to 0.15, c ranges from 0.04 to 0.25, preferably from 0.083 to 0.085, α ranges from 15° to 45°, preferably from 25° to 35°.

More preferably for the circumferential section (11) in correspondence of the outer end of the shaped rotor blade m ranges from 0.096 to 0.133, p ranges from 0.5 to 0.526, t ranges from 0.1 to 0.15, c ranges from 0.083 to 0.085, α ranges from 25° to 35°. The reversal point can be created by means of a shaped support element (6), whose distance from the rotation axis identifies a circumference that divides the area generated by transversally (horizontally) dividing the stator (15) into two different surface areas, preferably the same. The series of shaped rotor blades (3) is interposed with the series of shaped stator blades (16) so that a level (28) of shaped rotor blades (3) alternates with a level (29) of shaped stator blades (16), forming a very short distance g between the shaped rotor blades and the shaped stator blades (see FIG. 7), a distance that ranges between 5% and 100%, preferably between 7% and 20%, more preferably between 7% and 10%, of the height h of the shaped rotor blade, in order to obtain high speed gradients. The height of the blade h, as indicated in FIG. 3, is univocally determined once the values of parameters m, p, t, c and a of the blade profile have been assigned.

Both the shaped rotor blades (3) and the shaped stator blades (16) extend radially: the shaped rotor blades extend from the shaft (2) towards the inner side surface of the outer body (25), the shaped stator blades extend from the inner side surface of the outer body (25) towards the shaft (2). The shaped rotor or stator blades are equally spaced from one another in the angular direction: for example if there are two they are 180° from one another, if there are three they are at 120° and if there are four they are at 90°. Two successive levels of shaped rotor blades or shaped stator blades can be staggered from one another, i.e. not axially aligned but rotated with respect to one another by a certain angle: preferably if the number of blades is two, then two successive levels of blades are staggered by 90°; if there are three then two successive levels of blades are staggered by 60°; if there are four blades then two successive levels of blades are staggered by 45°.

The direction of extension of each level of shaped rotor blades and of each level of shaped stator blades is preferably normal to the rotation axis (22). Said levels of shaped rotor blades and shaped stator blades are not necessarily all the same as one another, but may differ in terms of number of blades and geometric profile of the blades on each level.

In the rotary stirring device (14) each level (29) of shaped stator blades (16) contains at least two shaped stator blades at equal distances from one another in the angular direction connected to the inner surface of said outer body (25). The shaped stator blades (16) are interposed with the shaped rotor blades (3), said shaped stator blades extending radially from the inner surface of the stator towards the rotation shaft (2). With reference to FIG. 4 the shaped stator blades are now described. Each shaped stator blade (16) is characterised in that it has the following characteristics:

the shaped stator blade includes at least one reversal point (19) of the thrust to the fluid which divides it into at least two elements, (20) and (26), in such a way that each element has a direction of thrust in the opposite direction with respect to the other, the circumferential section of each element forms a standard NACA four-digit airfoil shown as Digit 1, Digit 2, Digit 3 and Digit 4, as described in this text, in which:

i. the parameters m, p and t vary radially along the direction of extension of the shaped stator blade, and in particular the parameter m varies between 0.001 and 0.16, p varies between 0.01 and 0.8, t varies between 0.05 and 0.8, ii. the chord length c that connects the leading edge with the trailing edge of said profile varies radially along the direction of extension of the shaped stator blade, in particular it ranges between 0.02 and 0.15 times the diameter D of the rotor, iii. the chord has an inclination a with respect to the plane orthogonal to the rotation axis that varies radially along the direction of extension of the shaped stator blade, in particular α varies between 25° and 80° with respect to the plane orthogonal to the rotation axis.

In particular, with reference to FIG. 4, four circumferential sections of the shaped stator blade are identified, each of which forms a specific airfoil: a section (27) in correspondence of the connection with the wall of the stator (25), a section (30) in correspondence of the connection of the element (26) with the reversal point (19), a section (17) in correspondence of the connection of the element (20) with the reversal point (19), and a section (18) in correspondence of the inner end of the shaped stator blade.

For such particular sections, the parameters of the standard NACA four-digit airfoil, m, p, t, c and α may preferably assume the values in the intervals specified below.

For the circumferential section (18) in correspondence of the inner end of said blade, m ranges from 0.001 to 0.16, preferably from 0.001 to 0.091, p ranges from 0.01 to 0.8, preferably from 0.01 to 0.05, t ranges from 0.05 to 0.3, preferably from 0.15 to 0.18, c ranges from 0.02 to 0.15, preferably from 0.059 to 0.06, α ranges from 30° to 70°, preferably from 50° to 60°.

More preferably for the circumferential section (18) in correspondence of the inner end of said blade, m ranges from 0.001 to 0.091, p ranges from 0.01 to 0.05, t ranges from 0.15 to 0.18, c ranges from 0.059 to 0.06, α ranges from 50° to 60°.

For the circumferential section (17) in correspondence of the first element (20) with the reversal point (19), m ranges from 0.001 to 0.15, preferably from 0.001 to 0.091, p ranges from 0.01 to 0.75, preferably from 0.01 to 0.5, t ranges from 0.15 to 0.6, preferably from 0.35 to 0.4, c ranges from 0.02 to 0.15, preferably from 0.05 to 0.056, α ranges from 40° to 80°, preferably between 50° and 65°.

More preferably for the circumferential section (17) in correspondence of the connection of the first element (20) with the reversal point (19) m ranges from 0.001 to 0.091, p ranges from 0.01 to 0.5, t ranges from 0.35 to 0.4, c ranges from 0.05 to 0.056, α ranges from 50° to 65°.

For the circumferential section (30) in correspondence of the second element (26) with the reversal point (19), m ranges from 0.001 to 0.15, preferably from 0.001 to 0.091; p ranges from 0.01 to 0.75, preferably from 0.01 to 0.5; t ranges from 0.2 to 0.8, preferably from 0.45 to 0.55; c ranges from 0.02 to 0.15, preferably from 0.053 to 0.060; α ranges from 25° to 75°, preferably between 40° and 55°.

More preferably for the circumferential section (30) in correspondence of the connection of the second element (26) with the reversal point (19) m ranges from 0.001 to 0.091, p ranges from 0.01 to 0.5, t ranges from 0.45 to 0.55, c ranges from 0.053 to 0.060, α ranges from 40° to 55°.

For the circumferential section (27) in correspondence of the connection with the wall of the stator (25), m ranges from 0.001 to 0.15, preferably from 0.001 to 0.091, p ranges from 0.01 to 0.75, preferably from 0.01 to 0.5, t ranges from 0.2 to 0.8, preferably from 0.45 to 0.55, c ranges from 0.02 to 0.15, preferably from 0.053 to 0.060, α ranges from 25° to 75°, preferably between 40° and 55°.

More preferably for the circumferential section (27) in correspondence of the connection with the wall of the stator (25) m ranges from 0.001 to 0.091, p ranges from 0.01 to 0.5, t ranges from 0.45 to 0.55, c ranges from 0.053 to 0.060, $\alpha$ ranges from 40° to 55°. One of the elements of the shaped stator blade (16) is fixed to the inner surface of the outer body (25), while the other element (20) extends as far as the rotation shaft (2) but without touching it. Each element has a direction of thrust in the opposite direction with respect to the other element. The reversal point can be created by means of a shaped support element (19), whose distance from the rotation axis identifies a circumference that divides the area generated by transversally (horizontally) dividing the stator (15) into two different surface areas, preferably the same.

The reversal point of the shaped stator blades is preferably at the same distance from the rotations shaft as the reversal point of the shaped rotor blades, therefore they correspond.

For the purposes of the present invention the number of shaped rotor blades (3) in each level is at least two, preferably from 2 to 10, more preferably from 2 to 4. The number of shaped stator blades (16) in each level is at least two, preferably from 2 to 10, more preferably from 2 to 4.

The outer body (25) may have different shapes and be made of different materials. It may be positioned horizontally or vertically, may operate under pressure, at atmospheric pressure or under vacuum. Typically said body comprises a side wall and two bottoms; the side wall may be cylindrical, conical or another shape; the bottoms may be flat, conical, hemispherical, elliptical, torispherical or another shape. In particular said outer body preferably comprises a vertical metal cylinder with elliptical bottoms. The rotation shaft (2) is preferably coaxial with the axis of the outer body (25), and can work in a cantilever fashion or be equipped with a support at the opposite end with respect to the power unit.

In relation to FIG. 2, the rotor described and claimed herein can further comprise a level of shaped rotor blades whose outer element, the furthest from the rotation axis (2) is a means for scraping (12) the inner walls of the outer body (25). Normally this level of shaped rotor blades is positioned in the upper part of the rotation shaft (2), in particular in correspondence of the interphase surface of a two-phase fluid system, for example liquid-gas.

When the outer body (25) is a tank with a vertical axis, appropriate scraping means have a geometric profile that comprises a horizontal element connected to the rotation shaft, and an element orthogonal to said horizontal element, preferably having a rectangular section (12). Said horizontal element may be partly or completely the same as a shaped rotor blade (3). The scraping means keep the walls of the tank clean in correspondence of the interphase surface of a two-phase system, for example liquid-gas, which under normal operating conditions can tend to get dirty.

As can be seen from FIG. 1 and FIG. 2 the rotor described and claimed herein may further comprise a shaped anchor (13), positioned in the lower part of the rotation shaft (2) in correspondence of the bottom of the outer body in which it is installed. Said anchor is equipped with scraping means whose shape follows the shape of the bottom of the body (25) in which it is installed. Said anchor is also equipped with intermediate arms that have the mechanical function of reinforcing the scraping means. The anchor is therefore made so as to be adapted to the shape of the bottom of the outer body in which it is installed.

Said anchor is particularly useful as it helps to keep the bottom of the stirring device clean and keep stirring any solid that may be present. Furthermore, the overall configuration of the shaped rotor blades and shaped stator blades and the installation of the bottom anchor facilitate the restarting operations after the stirring device stops in the event of caking of any solid phase on the bottom due, for example, to electric power failure and subsequent sedimentation of the product on the bottom. In fact, this configuration can fragment and grind up the caked product unlike what happens in traditional stirring apparatuses (for example a Rushton turbine or a hydrofoil impeller with vertical baffles) which would not allow the caked product to be broken up and therefore the apparatus to restart, but would require the apparatus to be stopped and mechanically cleaned.

As previously mentioned the shaped rotor blades have a fluid thrust reversal point, a point in which the generated thrust is inverted. A fluid is preferably thrust towards the bottom of the outer body of the stirring device by the inner part of the shaped rotor blade, while it is preferably thrust towards the top of said body by the outer part. In every shaped rotor blade there may be various reversal points if the shaped rotor blade is split into three or more parts. With reference to the case in which there is a single reversal point, said reversal point may be positioned in proximity to the rotation shaft (2), or in proximity to the inner side surface of the outer body (25). Preferably, the distance of said reversal point from the rotation axis is such as to identify a circumference that splits the area generated into parts with different surfaces, preferably of the same area, by splitting the stator (15) transversally (horizontally).

Said reversal point may be made by connecting the different parts that form the shaped rotor blade to one another through a bolted, threaded or welded connection, and potentially through the use of an appropriate anchoring plate. The connection of said shaped rotor blade to said shaft may be made through welding, threading, keying or bolting.

In a preferred embodiment the rotor described and claimed herein has two successive levels of shaped rotor blades staggered from one another. Preferably in the rotor described and claimed herein all the levels of shaped rotor blades have the same number of shaped rotor blades and are the same as one another.

In a preferred embodiment the stirring device described and claimed herein has two successive levels of shaped stator blades staggered from one another. In the stirring device described and claimed herein all the levels of shaped stator blades preferably have the same number of shaped stator blades and are the same as one another.

The shaped profile of the shaped rotor blade may be obtained starting from one or more forged or semi-finished parts, preferably bars and plates, subjected to processes for the removal of swarf and welded together. Furthermore said shaped rotor blade may be made through the use of bars and plates, bent, curved and twisted, welded together so as to better approach said airfoil. The parts that comprise the shaped rotor blade may be made of different material: if said materials are not weldable to one another, alternative connections to welding can be provided, such as bolting, coupling by interference and brazing.

The shaped stator blades also have a reversal point wherein the generated thrust is inverted. With respect to the shaped stator blade, the element close to the rotation shaft pushes a multi-phase fluid towards the bottom of the outer body of the stirring device, while the element close to the inner side surface of said body pushes the fluid upwards. Every shaped stator blade has a least one reversal point. Said reversal point may be positioned in proximity to the rotation shaft, or in proximity to the inner side wall of the outer body of the stirring device. The distance of said reversal point from the rotation axis is such as to identify a circumference that splits the area generated into different parts, preferably of the same surface area, by splitting the stator transversally (horizontally).

Said reversal point may be made by connecting the different parts that form the shaped stator blade to one another through a bolted, threaded or welded connection, and potentially through the use of an appropriate anchoring plate. The connection of said shaped stator blade to the side wall of the outer body of the stirring device can be made through welding, threading or bolting.

The shaped profile of the shaped stator blade may be obtained starting from one or more forged or semi-finished parts, preferably bars and plates, subjected to processes for the removal of swarf and welded together. Furthermore said shaped stator blade may be made through the use of bars and plates, bent, curved and twisted, subsequently welded together so as to better approach said airfoil. The parts that comprise the shaped stator blade may be made of different material: if said materials are not weldable to one another, alternative connections to welding can be provided, such as bolting, coupling by interference and brazing.

The particularly innovative aspect of the stirring device described and claimed consists of the actual use of a series of shaped rotor blades and shaped stator blades having a particular shape, along with the reversal of the thrust direction for different radial sections. This innovative geometry unexpectedly allows a device to be obtained which can effectively and uniformly mix single phase or multi-phase fluids, particularly those with high viscosity, in particular non-Newtonian ones.

The use of a series of appropriately shaped rotor and stator blades according to the present invention allows the turbulence, the velocity gradients and the strains on the whole volume of mixed fluid to be distributed uniformly. The particular fluid dynamic profile of the shaped rotor blades and the shaped stator blades, which is radially variable, allows the fluid to be moved effectively and efficiently. The radial reversal of the axial thrust direction allows a multi-directional flow to be obtained within the stirring device, thus obtaining a high degree of mixing.

The subject matter of the present invention therefore consists in a device adapted for the mixing of fluids both in turbulent and laminar flow. In particular, the subject matter of the present invention is adapted for mixing fluids whose transport properties vary according to the level of turbulence, the speed gradients and the local strains, and which therefore require a high level of homogeneity and uniformity within the mixing tank, therefore obviating the limits of the prior art in such application field. The device according to the present invention is therefore able to effectively mix fluids in turbulent flow, minimising the calm areas, reducing the possibility of caking and/or gelation of any solids contained, effectively and homogenously dispersing any dispersed phases contained (liquids, solids, gases). The system according to the present invention is also adapted for mixing fluids in the presence of chemical reactions, in adiabatic mode or with heat exchange, in continuous or discontinuous mode.

In relation to FIG. 5, the standard NACA four-digit airfoil formed by the circumferential sections of the first and the second element of a shaped rotor blade or a shaped stator blade, described and claimed herein, may be made with a curvilinear profile (21); or with a continuous segmented profile (24) comprising n segments, wherein two consecutive segments form an angle R, with n that varies between 2 and 10, preferably between 4 and 8, and β varies between 0.1° and 270°.

In a third alternative, the standard NACA four-digit airfoil formed by the circumferential sections of the first and the second element of a shaped rotor blade or a shaped stator blade, described and claimed herein, may be made with a curvilinear profile comprising a combination of curvilinear sections and n segments, wherein two consecutive segments form an angle β, which varies between 0.1° and 270°, with n that varies between 2 and 10.

A segmented profile may be comprised of n consecutive segments, with n that varies between 2 and 10, preferably between 4 and 8, such that the set of points that constitute the ends of said segments can be identified through a standard NACA four-digit profile as described in the text. Such points may also not coincide with the points of a standard NACA four-digit profile as described in the text; they must however differ from it by no more than 10% of the length of the chord, where the difference means the minimum radius of the circumference having a centre that coincides with the point and tangent to the profile. Furthermore, the area not overlapping between the profile with segments and the NACA airfoil must be less than 10% of the total area of the NACA airfoil.

Below a representative example of the invention is proposed.

Example 1

In this example, the subject matter of the invention has been applied to an apparatus on pilot scale with the following characteristics: vertical tank with elliptical bottoms, diameter 670 mm, filling height 680 mm from lower tangency line, mixed volume 0.28 cubic meters. In the tank a two-phase fluid is mixed continuously, comprising a mixture of C2-C3 hydrocarbons and an appropriate catalyst to make a polymerisation reaction take place in suspension. The reaction conditions are 10-20 bar and 15-40° C. In such conditions ~2-4% in weight of solid polymer are obtained in suspension in the mixture of reagents. The apparatus described was initially equipped with a stirrer comprising a series of rotor blades and stator blades connected to the shell, which represents the reference case of the known art prior to the subject matter of the invention.

The rotor blades, with diameter 660 m, are arranged on 7 levels, each level containing 2 blades, successive levels staggered by 90°. The stator blades are arranged on 7 levels, each level containing 4 blades, successive levels not staggered. The stator blades are 280 mm long. Each rotor blade is made of a horizontal metal bar, 20 mm tall, whose surface which first meets the fluid is inclined by 60° with respect to the plane perpendicular to the rotation axis, so as to impart upwards motion to the fluid. The stator blades are formed by a cylinder of diameter 20 mm. The gap between a rotor blade and a stator blade is 21.5 mm. The stirrer is further equipped with a bottom anchor shaped like the elliptical bottom (gap between anchor and bottom about 5 mm) and wall scraping means on the upper level of the rotor blades. The rotation speed is equal to 150 rpm.

The rotor and the stator blades have therefore been replaced with a new rotor and new shaped stator blades as described in the present invention.

The shaped rotor blades and shaped stator blades are equipped with a single reversal point, positioned 240 mm away from the rotation axis. With reference to FIG. 3 and the text of the present invention, the airfoil of the shaped rotor blades is characterised by the parameters reported in the following Table A:

TABLE A

| Section | 8 | 9 | 10 | 11 |
|---|---|---|---|---|
| m | 0.001 | 0.001 | 0.001 | 0.091 |
| p | 0.01 | 0.01 | 0.01 | 0.5 |
| t | 0.4 | 0.4 | 0.16 | 0.22 |
| c | 0.060 | 0.060 | 0.072 | 0.054 |
| α [°] | 45 | 45 | 38 | 30 |

With reference to FIG. 4 and the text of the present invention, the airfoil of the shaped stator blades is characterised by the parameters reported in the following Table B:

TABLE B

| Section | 18 | 17 | 27 and 30 |
|---|---|---|---|
| m | 0.001 | 0.077 | 0.102 |
| p | 0.01 | 0.424 | 0.438 |
| t | 0.3 | 0.55 | 0.55 |
| c | 0.051 | 0.043 | 0.052 |
| α [°] | 45 | 60 | 40 |

The shaped rotor blades, with diameter 660 mm, are arranged on 7 levels, each level containing 2 blades, successive levels staggered by 90°. The shaped stator blades are arranged on 7 levels, each level containing 4 blades, successive levels not staggered. The shaped stator blades are 280 mm long. The gap between a rotor blade and a stator blade is 16.5 mm. The stirrer is further equipped with a bottom anchor shaped like the elliptical bottom (gap between anchor and bottom about 5 mm) and wall scraping means on the upper level of the shaped rotor blades. The rotation speed is equal to 150 rpm.

The performance levels of the subject matter of the invention in this example were verified through CFD (computational fluid dynamic) techniques. For the analysis, the commercial software ANSYS CFX was used, with a calculation mesh with over 4 million tetrahedral elements, K-epsilon turbulence model, single-phase Newtonian fluid with density of 500 kg/m3 and viscosity of 0.0002 Pa s.

From the analysis performed, with respect to the reference case for the subject matter of the invention, there was an increase in mixed flow rate of over 3 times, while the absorbed power varied within 10% with respect to the reference case. The power was calculated as a product of the torque moment on the rotor blades and the rotation speed, while the mixed flow rate was calculated as the flow rate upwards through a plane orthogonal to the rotation axis and placed half way up the height of a rotor blade.

The invention claimed is:

1. A rotor which includes a shaft, a series of shaped rotor blades arranged along the whole or part of the length of said shaft, said blades extending parallel to a plane orthogonal to a rotational axis of said shaft; said series of shaped rotor blades contains at least one level of shaped rotor blades; each level contains at least two shaped rotor blades equally spaced about said shaft; said shaped rotor blades are connected to said shaft by means of one of their ends;

a) wherein the shaped rotor blade comprises at least one reversal point of the thrust to the fluid, said reversal point divides said shaped rotor blade into at least two elements which extend radially with respect to one another, so that each element has a direction of thrust in the opposite direction with respect to the other, b) wherein the circumferential section of each element forms a standard NACA four-digit airfoil shown as Digit 1, Digit 2, Digit 3 and Digit 4, in which:

i. the parameters m, p, and t range radially along the direction of extension of the shaped rotor blade, ii. the chord length c that connects the leading edge with the trailing edge of said profile varies radially along the direction of extension of the shaped rotor blade, iii. the chord has an inclination a with respect to the orthogonal plane to the rotation axis that varies radially along the direction of extension of the shaped rotor blade.

2. The rotor according to claim 1 in which m ranges between 0.001 and 0.25, p ranges between 0.01 to 0.85, t ranges between 0.015 and 0.75, the chord length c ranges between 0.02 and 0.25 times the rotor diameter D, and wherein the angle α of inclination of the chord ranges between 15° and 75° with the plane orthogonal to the rotation axis.

3. The rotor according to claim 2 wherein the circumferential section of the shaped rotor blade in correspondence of the connection with the shaft forms said airfoil in which m ranges from 0.001 to 0.15, p ranges from 0.01 to 0.85, t ranges from 0.2 to 0.75, c ranges from 0.02 to 0.15, α ranges from 20° to 75°.

4. The rotor according to claim 2 wherein the circumferential section of the shaped rotor blade in correspondence of the connection of the first element with the reversal point forms said airfoil in which m ranges from 0.001 to 0.25, p ranges from 0.01 to 0.7, t ranges from 0.2 to 0.65, c ranges from 0.02 to 0.2, α ranges from 15° to 60°.

5. The rotor according to claim 2 wherein the circumferential section of the shaped rotor blade in correspondence of the connection of the second element with the reversal point forms said airfoil in which m ranges from 0.001 to 0.15, p ranges from 0.01 to 0.7, t ranges from 0.02 to 0.25, c ranges from 0.04 to 0.2, α ranges from 20° to 60°.

6. The rotor according to claim 2 wherein the circumferential section of the shaped rotor blade in correspondence of the outer end of said blade form said airfoil in which m ranges from 0.001 to 0.25, p ranges from 0.01 to 0.75, t ranges from 0.015 to 0.25, c ranges from 0.04 to 0.25, α ranges from 15° to 45°.

7. The rotor according to claim 1 wherein said airfoil of the shaped rotor blade is made with a curvilinear profile; or with a segmented continuous profile consisting of n segments in which two consecutive segments form an angle β, where n ranges between 2 and 10 and β ranges between 0.1° and 270°.

8. The rotor according to claim 1 wherein said airfoil of the shaped rotor blade is realized with a continuous profile consisting of a combination of curvilinear sections and n segments in which two consecutive segments form an angle β which ranges between 0.1° and 270°, with n varying between 2 and 10.

9. A stirring device comprising:

the rotor according to claim 1, which has the function of agitating a single-phase or multiphase fluid imparting motion, and a stator that comprises an outer body and a series of shaped stator blades arranged on all or part of the inner side surface of said body; said series of shaped stator blades contains at least one level of shaped stator blades; each level contains at least two shaped stator blades equally spaced in the angular direction; the shaped stator blades are fixed to the inner side surface of said outer body by one of their ends, said stator having the function of transforming the motion generated by the rotor into predominantly axial flow.

10. A stirring device according to claim 9 in which the shaped stator blade has the following features:

the shaped stator blade includes at least one reversal point of the thrust to the fluid which divides it into at least two elements in such a way that each element has a direction of thrust in the opposite direction with respect to the other, the circumferential section of each element forms a standard NACA four-digit airfoil, indicated as Digit 1, Digit 2, Digit 3 and Digit 4, in which:

i. the parameters m, p, t vary radially along the direction of extension of the shaped stator blade element, ii. the chord length c that connects the leading edge with the trailing edge of said profile varies radially along the direction of extension of the stator blade shaped element, iii. the chord has an inclination a with respect to the plane orthogonal to rotation axis which varies radially along the direction of extension of the shaped stator blade.

11. The device according to claim 10 in which the circumferential section of the shaped stator blade forms said airfoil in which the parameter m ranges between 0.001 and 0.16, p ranges between 0.01 to 0.8, t ranges from 0.05 to 0.8, c ranges between 0.02 and 0.15 times the rotor diameter D, the angle $\alpha$ of inclination of the chord ranges between 25° and 80° relative to the plane orthogonal to rotation axis.

12. The device according to claim 11 in which the circumferential section of the shaped stator blade in correspondence of the inner end of said blade forms said airfoil in which m ranges from 0.001 to 0.16, p ranges from 0.01 to 0.8, t ranges from 0.05 to 0.3, c ranges from 0.02 to 0.15, $\alpha$ ranges from 30° to 70°.

13. The device according to claim 11 in which the circumferential section of the shaped stator blade in correspondence of the connection of the first element with the reversal point forms said airfoil in which m ranges from 0.001 to 0.15, p ranges from 0.01 to 0.75, t ranges from 0.15 to 0.6, c ranges from 0.02 to 0.15, $\alpha$ ranges from 40° to 80°.

14. The device according to claim 11 in which the circumferential section of the shaped stator blade in correspondence of the connection of the second element with the reversal point forms said airfoil in which m ranges from 0.001 to 0.15, p ranges from 0.01 to 0.75, t ranges from 0.2 to 0.8, c ranges from 0.02 to 0.15, $\alpha$ ranges from 25° to 75°.

15. The device according to claim 11 in which the circumferential section of the shaped stator blade in correspondence of the connection with the wall of the stator forms said airfoil in which m ranges from 0.001 to 0.15, p ranges from 0.01 to 0.75, t ranges from 0.2 to 0.8, c ranges from 0.02 to 0.15, $\alpha$ ranges from 25° to 75°.

16. The device according to claim 10, wherein said airfoil of the shaped stator blade is made with a curved profile; or with a continuous segmented profile consisting of n segments in which two consecutive segments form an angle $\beta$, where n ranges between 2 and 10 and $\beta$ ranges between 0.1° and 270°.

17. The device according to claim 10 wherein said airfoil of the shaped stator blade is realized with a continuous profile consisting of a combination of curvilinear and n segments in which two consecutive segments form an angle $\beta$ which ranges between 0.1° and 270°, with n ranging between 2 and 10.

18. The device according to claim 9 wherein the series of shaped rotor blades is between to the series of shaped stator blades so that it is the alternation of a level of shaped rotor and a level of shaped stator blades, forming a distance between shaped rotor blades and shaped stator blades that ranges from 5% to 100% of the height h of the shaped rotor blade.

19. The device according to claim 9 wherein the shaped rotor blades and shaped stator blades are equally spaced in the angular direction.

20. The device according to claim 10, wherein the reversal point of the shaped stator blade or that of the shaped rotor blade, or both, is an element of shaped support whose distance from the rotation axis defines a circumference which divides the area generated transecting the stator into two areas of equal surface.

21. A method for preparing the airfoil shaped rotor blade of claim 1 comprising: a) chips removal or welding together one or more forged or semi-finished bars or plates; or b) bending, twisting and bending bars and sheets, and then welding said bars and sheets between themselves in such a way as to approximate at best said airfoil.

22. A method for preparing the shaped stator blades of the stirring device of claim 10 comprising: a) chips removal or welding together one or more forged or semi-finished bars or plates or b) bending, twisting and bending bars and sheets, and then welding said bars and sheets between themselves in such a way as to approximate at best said airfoil.

* * * * *